US006840143B1

(12) United States Patent
Lin

(10) Patent No.: US 6,840,143 B1
(45) Date of Patent: Jan. 11, 2005

(54) ADAPTER FOR SCREWDRIVER HAVING ELASTIC RETAINER RING

(76) Inventor: Ying-Mo Lin, No. 161, Lane 243, Sec.2, Chang Shin Rd., Hemei Jen, Chang-Hua Hsien (TW)

( * ) Notice: Subject to any disclaimer, the term of this patent is extended or adjusted under 35 U.S.C. 154(b) by 0 days.

(21) Appl. No.: 10/601,214

(22) Filed: Jun. 20, 2003

(51) Int. Cl.[7] ..... B25B 23/00
(52) U.S. Cl. ..... 81/438; 81/177.85
(58) Field of Search ..... 81/438, 177.85, 81/177.2

(56) References Cited

U.S. PATENT DOCUMENTS 4,589,308 A * 5/1986 Palm ..... 81/177.85
5,309,798 A * 5/1994 Markwart et al. ..... 81/438
5,333,523 A * 8/1994 Palm ..... 81/177.85
5,481,949 A * 1/1996 Yen ..... 81/438
5,528,963 A * 6/1996 Wei ..... 81/63
5,533,429 A * 7/1996 Kozak ..... 81/439
5,881,614 A * 3/1999 Cheng-Tsan ..... 81/438
5,934,384 A * 8/1999 Wang ..... 173/132
6,267,031 B1 * 7/2001 Cheng ..... 81/177.2
2002/0134205 A1 * 9/2002 Hsu ..... 81/177.85

* cited by examiner

*Primary Examiner*—David B. Thomas
(74) *Attorney, Agent, or Firm*—Charles E. Baxley

(57) ABSTRACT

An adapter of screwdriver for coupling with screwdriver bits and the likes and generally comprising a sleeve, a slide ring, a spring and a retainer ring. The slide ring is a column member interiorly defined with a multi-stage hole, at the front of which is provided with a cone inner ring having increased cone ratio, a secondary inner ring and a big inner ring in turn, the sleeve has a hexagonal socket hole formed at the front end thereof and at the same an annular groove is defined for engaging with a C-shape ring, the retainer ring, the C-shape ring, the spring and a ring are mounted to a assembling diameter of the sleeve, which is characterized in: at the outer periphery of the assembling diameter of the sleeve thereof a hole is defined for the passage of the downward flange, through which, the downward flange is able to engage in the retainer groove of the screwdriver bit.

1 Claim, 5 Drawing Sheets

ADAPTER FOR SCREWDRIVER HAVING ELASTIC RETAINER RING

BACKGROUND OF THE INVENTION

1. Field of the Invention

The present invention relates to a hand tool, and more particularly to an adapter of screwdriver for engaging with screwdriver bits and the likes.

2. Description of the Prior Arts

A conventional screwdriver bits adapter for screwdriver is normally designed as having a sleeve for cooperating with an annular groove 11 in the connecting rod 1 or screwdriver bit. Moreover, the connecting rod 1 may has a steel ball disposed in a through hole which connected with the socket hole of the sleeve 21 so as to position or disengage the joint adapter which has been disposed in the socket hole. Since the above-mentioned positioning or disengaging devices works based on the manner of floating position, the possibility of jam of the sleeve is quite great.

The present invention has arisen to mitigate and/or obviate the afore-described disadvantages of the conventional adapter of screwdriver for coupling with screwdriver bits and the likes.

SUMMARY OF THE INVENTION

In accordance with one aspect of the present invention there is provided with an adapter of screwdriver for coupling with screwdriver bits and the likes and generally comprising: a sleeve, a slide ring, a spring and a retainer ring. The slide ring is a column member interiorly defined with a multi-stage hole, at the front of which is provided with an cone inner ring having increased cone ratio, an secondary inner ring and a big inner ring in turn, the sleeve has a hexagonal socket hole formed at the front end thereof and at the same an annular groove is defined for engaging with a C-shape ring, the retainer ring, the C-shape ring, the spring and a ring are mounted to a assembling diameter of the sleeve, which is characterized in: the retainer ring is provided with a gap and has an internal diameter be minor than the assembling diameter of the front end of the sleeve, which is further axially provided with a flange in connecting with a downward flange. At the outer periphery of the assembling diameter of the sleeve thereof a hole is defined for the passage of the downward flange, through which, the downward flange is able to engage in the retainer groove of the screwdriver bit.

The present invention will become more obvious from the following description when taken in connection with the accompanying drawings, which shows, for purpose of illustrations only, the preferred embodiment in accordance with the present invention.

DETAILED DESCRIPTION OF THE PREFERRED EMBODIMENTS

Figure 1:
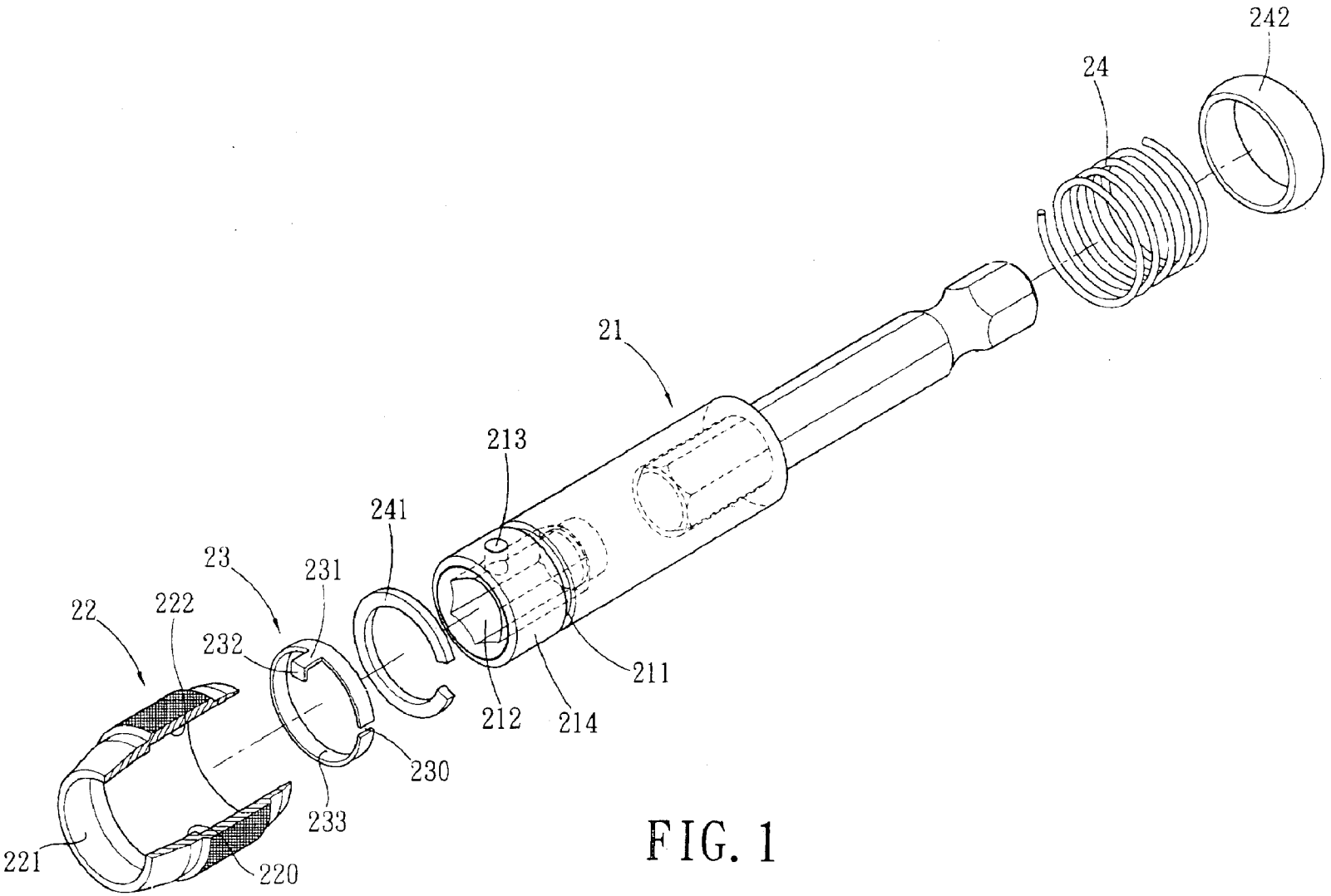
FIG. 1 is an exploded view of an adapter of screwdriver for coupling with screwdriver bits and the likes in accordance with the present invention.
Figure 2:
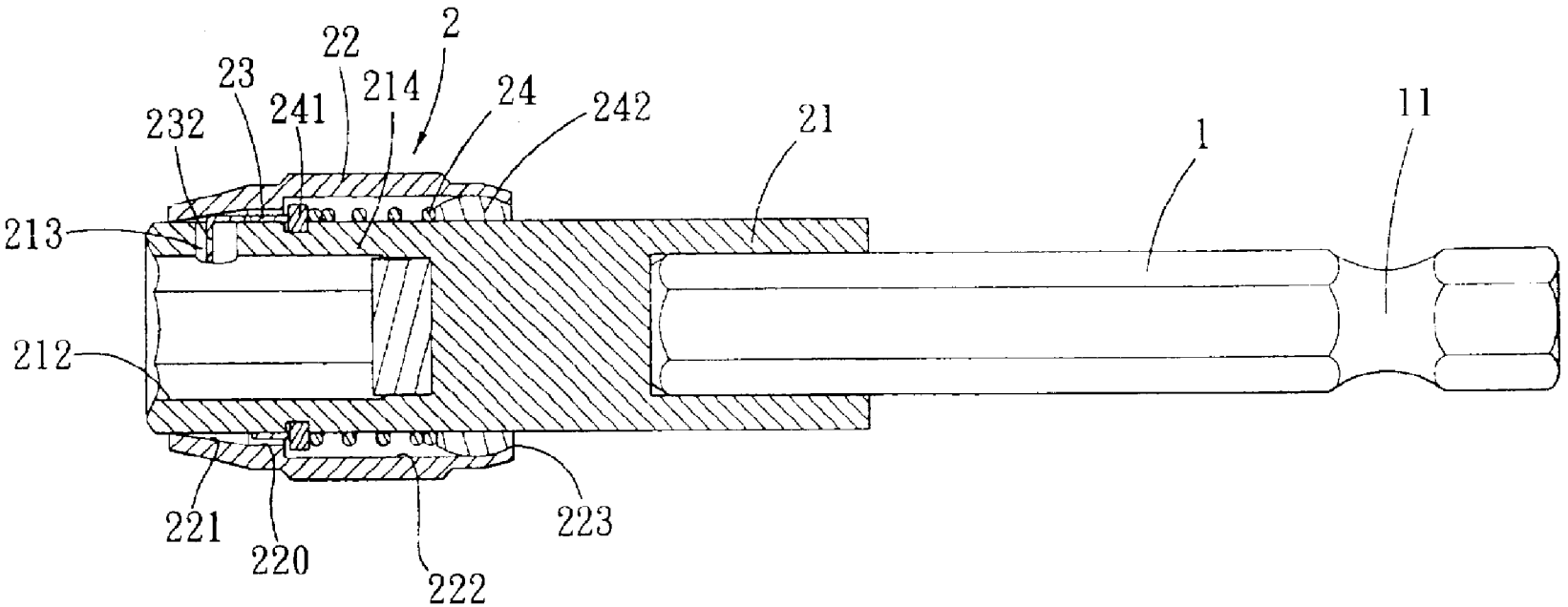
FIG. 2 is a cross sectional view of the adapter of screwdriver for coupling with screwdriver bits and the likes in accordance with the present invention.
Figure 3:
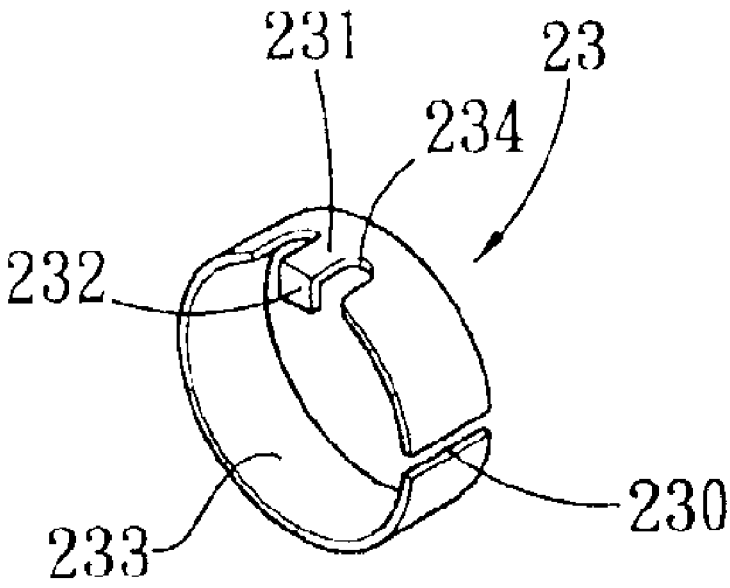
FIG. 3 is a perspective view of a retainer ring of the adapter for screwdriver in accordance with another embodiment of the present invention.

Referring to FIGS. 1–2, an adapter 2 for screwdriver having elastic retainer ring generally comprises a sleeve 21, a slide ring 22, a spring 24 and a retainer ring 23. Wherein the sleeve 21 is provided at an end with a hexagonal hole for engaging with conventional connecting rod 1, the connecting rod 1 is provided with an annular groove 11 which is a conventional positioning groove. The connecting rod 1 also has a steel ball disposed in a through hole which connected with the socket hole of the sleeve 21 so as to position or disengage the adapter which has been disposed in the socket hole, this kind of structure belongs to prior arts, so any further remarks on the matter would seem superfluous. At the front end of the sleeve 21 is defined with a hexagonal socket hole 212 and at the outer periphery of the sleeve 21 where contiguous to the front end thereof is formed with a hole 213, behind which an annular groove 211 is defined for receipt of a C-shape ring 241. The hole 213 is connected with the socket hole 212. The slide ring 22 is a hollow column member interiorly defined with a multi-stage hole which including an cone inner ring 221 having increased cone ratio and a secondary inner ring 220 defined at the front end respectively, next to which is defined with a big inner ring 222 having a greatest diameter. A shoulder is formed between the big inner ring 222 and the secondary inner ring 220 such that on which the C-shape ring 241 and the spring 24 can be rested respectively. The retainer ring 23 has a gap 230 and its internal diameter 233 is minor than the assembling diameter 214 of the front end of the sleeve 21, which is further axially provided with a flange 231 in connecting with a downward flange 232. The retainer ring 23 is mounted onto the assembling diameter 214 of the front end of the sleeve 21 and surrounds the same tightly due to its elasticity, at the same time, with the downward flange 232 passing through the hole 213 and engaging in the retainer groove 31 of the screwdriver bit 3. The spring 24 is disposed between the big inner ring 222 and the assembling diameter 214 of the sleeve 21 with a ring 242 mounted thereof. With reference to FIG. 2, the big inner ring 222 is provided with a chamfer 223 for retaining the ring 242, the C-shape ring 241 rests on the shoulder of the big inner ring 222 such that the spring 24 is compressed and has elastic force stored. The chamfer 223 can be in form of annulations or dots so as to retain the ring 242. With referring to FIG. 3, wherein a retainer ring 23 in accordance with another preferred embodiment of the present invention is shown and having a greater diameter with respect to that retainer ring 23 in FIG. 1 so as to provide a rather greater elasticity while surrounding the assembling diameter 214. Furthermore, at both sides of the downward flange 232 a notch 234 is defined respectively, such that the flange 231 will be flexible for facilitating the upward raise of the downward flange 232.

Referring to FIGS. 1 and 2, in which, the C-shape ring 241 and the retainer ring 23 are disposed in the annular groove 211 and the assembling diameter 214 respectively at the front of the sleeve 21. The downward flange 232 of the retainer ring 23 passes through and protrudes out a little of the hole 213. At the same time, the spring 35 and the ring 242 are mounted to the assembling diameter 214 of the sleeve 21 in turn. And the slide ring 22 is then mounted to the assembling diameter 214 too, the ring 242 is retained by virtue of the chamfer 223 of the big inner ring 222, the C-shape ring 241 rests on the shoulder of the big inner ring 222 and the spring 24 is biased and compressed between the C-shape ring 241 and the ring 242 such that has certain elasticity. With reference to FIG. 2, in which, between the secondary inner ring 220 of the slide ring 22 and the flange 231 of the retainer ring 23 is defined with a clearance such that the downward flange 232 is allowed to raised up in case of deformation of the flange 231.

Figure 4:
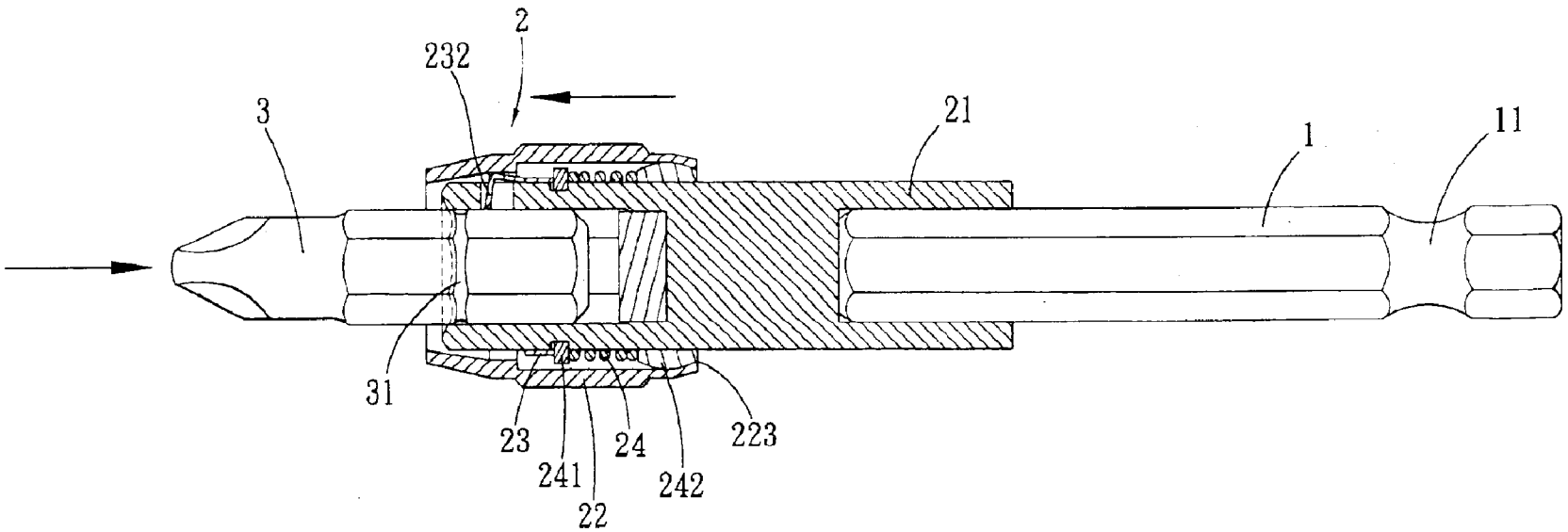
FIG. 4 is a cross sectional view of showing the adapter of screwdriver for coupling with screwdriver bits and the likes in accordance with the present invention is engaging with a screwdriver bit.
Figure 5:
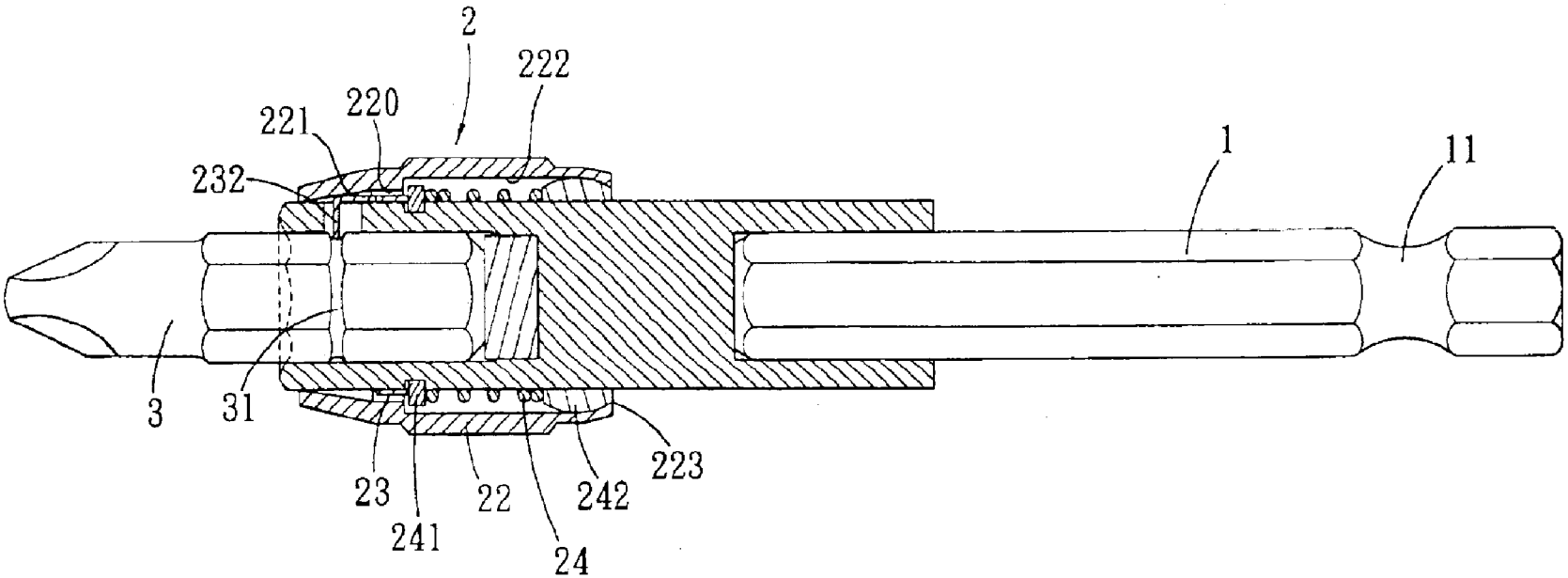
FIG. 5 is another cross sectional view of showing the adapter of screwdriver for coupling with screwdriver bits and the likes in accordance with the present invention is engaging with a screwdriver bit.

Referring to FIG. 4, in which, the slide ring 22 is moved upward first, which effects the synchronous upward movement of the ring 242 along the sleeve 21 so as to compress the spring 24. The screwdriver bit 3 is inserted in the socket hole 212 of the sleeve 21, since there is space in the cone inner ring 221 the flange 231 of the retainer ring 23 is not pressed, such that the screwdriver bit 3 will push the downward flange 232 of the retainer ring 23 to raise upward, thereby the screwdriver bit 3 may be easily disengaged from the adapter 2 of the screwdriver. With reference to FIG. 5, when the user release his/her hand and the spring 24 recovered its original shape, the flange 231 of the retainer ring 23 will be pressed by the front end of the cone inner ring 221, such that effects the downward movement of the downward flange 232 of the retainer ring 23 and make it engaged in the retainer groove 31 of the screwdriver bit 3, thereby the screwdriver bit 3 is fixed rigidly.

Due to the retainer ring 23 is provided with certain elasticity, the adapter 2 of the screwdriver in accordance with the present invention is capable of fixing and coupling screwdriver bits 3 or the likes firmly while we have shown and described various embodiments in accordance with the present invention, it should be clear to those skilled in the art that further embodiments may be made without departing from the scope of the present invention.

What is claimed is:

1. An adapter for screwdriver having elastic retainer ring comprising: a sleeve, a slide ring, a spring and a retainer ring, wherein the slide ring is a column member interiorly defined with a multi-stage hole, in the a front of the multi-stage hole is sequentially provided an cone inner ring having increased cone ratio, a secondary inner ring and a big inner ring a hexagonal socket hole and an annular groove are defined at the front end of the sleeve, and the annular groove is used to receive a C-shape ring, the retainer ring, the C-shape ring, the spring and a ring are mounted to a assembling diameter of the sleeve, the retainer ring is formed with a gap and an internal diameter of the retainer ring is minor than the assembling diameter of the front end of the sleeve, the retainer ring is further axially provided with a flange in connecting with a downward flange, at the outer periphery of the assembling diameter of the sleeve thereof a hole is defined for the passage of the downward flange, through which, the downward flange is able to engage in a retainer groove of the screwdriver bit;

the retainer ring is further provided at both sides of the downward flange with a notch, respectively.

* * * * *